United States Patent [19]

Takahashi

[11] Patent Number: 5,057,680

[45] Date of Patent: Oct. 15, 1991

[54] ULTRAFAST GATING APPARATUS HAVING CHARACTERISTIC IMPEDANCE OF STRIP LINE SMALLER ON ITS INPUT SIDE THAN THE OUTPUT SIDE

[75] Inventor: Akira Takahashi, Shizuoka, Japan

[73] Assignee: Hamamatsu Photonics K. K., Shizuoka, Japan

[21] Appl. No.: 551,443

[22] Filed: Jul. 12, 1990

[30] Foreign Application Priority Data

Aug. 4, 1989 [JP] Japan ..... 1-202585

[51] Int. Cl.[5] ..... H01J 40/14

[52] U.S. Cl. ..... 250/207; 250/213 VT

[58] Field of Search ..... 250/207, 213 VT; 313/103 CM, 105 CM, 532, 529

[56] References Cited

U.S. PATENT DOCUMENTS

| | | | |
|---|---|---|---|
| 4,853,595 | 8/1989 | Alfano et al. | 313/532 |
| 4,870,350 | 9/1989 | Schlienkofer et al. | 250/213 VT |
| 4,882,480 | 11/1989 | Oba et al. | 250/213 VT |
| 4,956,548 | 9/1990 | Alfano et al. | 250/213 VT |

FOREIGN PATENT DOCUMENTS

| | | |
|---|---|---|
| 1347048 | 2/1984 | United Kingdom . |
| 2209243 | 5/1989 | United Kingdom . |

OTHER PUBLICATIONS

Gary Power et al., "Characterization of Gated Microchannel Plate X-Ray Imaging Systems", SPIE, vol. 981, High Speed Photography, Videography, and Photonics VI (1988), pp. 166–175.

D. K. Bradley et al., "X-Ray Gated Images of Imploding Microballoons", SPIE, vol. 981, High Speed Photography, Videography, and Photonics VI (1988), pp. 176–185.

Young et al., "Experiment Demonstration of a 100-ps Microchannel Plate Framing Camera", Rev. Sci. Instrum., 57 (11), Nov. 1986, pp. 2729–2732.

*Primary Examiner*—David C. Nelms

*Assistant Examiner*—Stephone Allen

*Attorney, Agent, or Firm*—Finnegan, Henderson, Farabow, Garrett and Dunner

[57] ABSTRACT

A stripline is composed of a microchannel plate, and a gold transmission path and grounded electrode formed on both surfaces of the microchannel plate. X-ray images projected onto the transmission path is gated by a pulse voltage applied to and propagating through the stripline. The stripline has such a characteristic impedance profile as decreases toward its output end. This impedance profile compensates for a voltage drop due to the transmission loss which would otherwise appear.

9 Claims, 6 Drawing Sheets

FIG. 1A
FIG. 1B
FIG. 1C
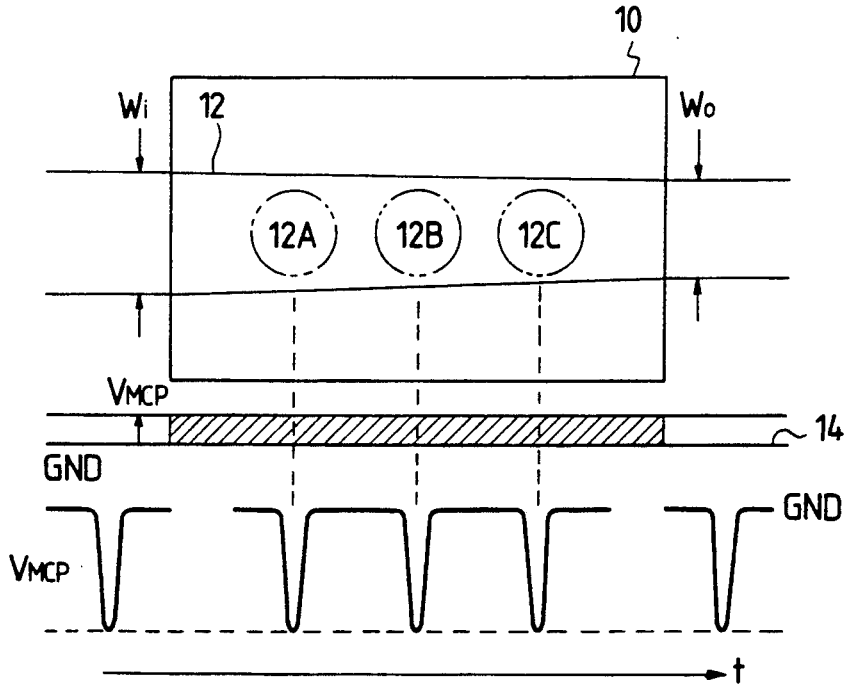
FIG. 2
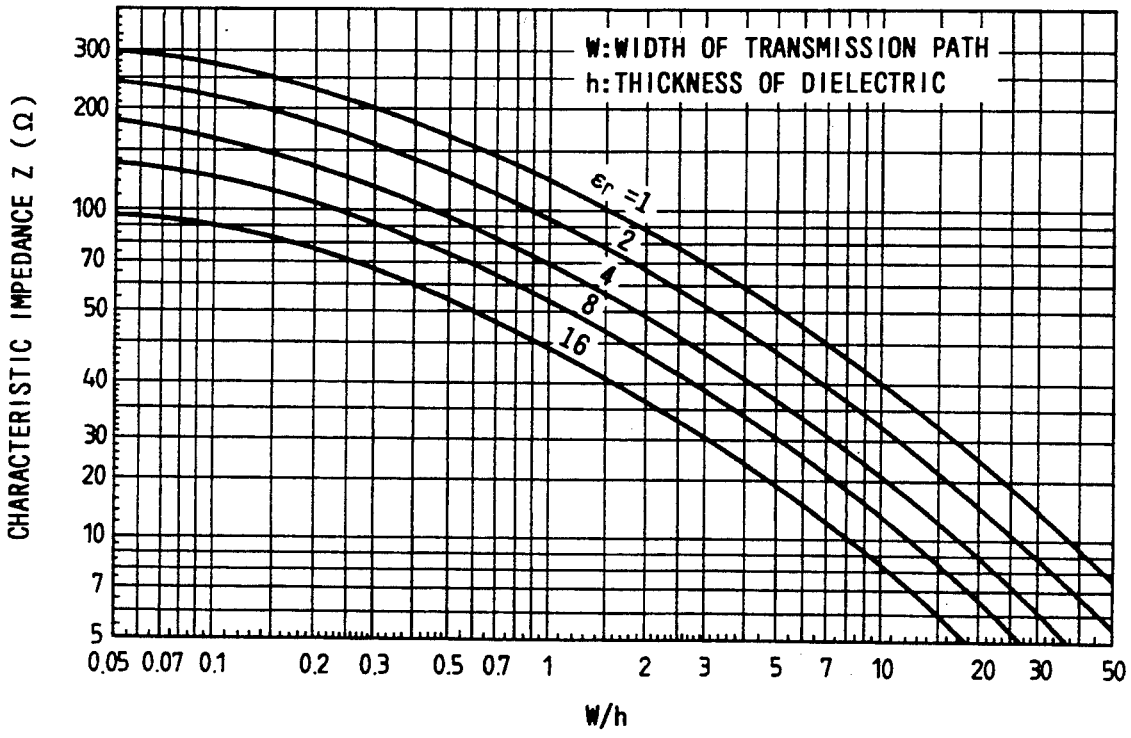

ULTRAFAST GATING APPARATUS HAVING CHARACTERISTIC IMPEDANCE OF STRIP LINE SMALLER ON ITS INPUT SIDE THAN THE OUTPUT SIDE

BACKGROUND OF THE INVENTION

This invention relates to an ultrafast gating apparatus equipped with a device for gating X-ray images, electron images or optical images being projected onto a stripline by a pulse voltage propagating through said stripline.

A microchannel plate (hereinafter referred to as "MCP") equipped with a stripline has conventionally been used as a device for gating X-ray images being projected onto the stripline by a pulse voltage applied thereto. Such a gating device is typically employed in an X-ray imaging system which, as typically shown in FIGS. 8 and 9, comprises MCP 1 and a gold transmission path 2 that is vapor-deposited on the MCP 1 and which also serves as a conversion surface to convert an X-ray to electrons. A stripline is formed by the transmission path 2, the MCP 1 as a dielectric, and a grounded electrode 3 on the output surface of the MCP 1.

When an X-ray image from an X-ray pinhole system 4 or the like is projected onto the transmission path (conversion surface) 2, the resulting electrons are multiplied with a "shutter time" that is determined by the width of the pulse voltage applied to the transmission path 2 and the gain characteristic of the MCP 1. The multiplied electrons strike a phosphor screen 5, where they are converted to visible light. The visible light image on the phosphor screen 5 is equivalent to the X-ray image on the transmission path 2, and has duration of the above-defined shutter time (or gating time).

The gated X-ray imaging system described above is capable of successively picking up images at an interval defined by the difference in the arrival times of the applied voltage pulse at the adjacent X-ray images on the stripline. The principle of this successive imaging is briefly described below with reference to FIG. 8. Three identical X-ray images 2A, 2B and 2C are aligned on a stripline as a result of projection through three pinholes 4A, 4B and 4C. The respective X-ray images 2A, 2B and 2C are to be gated with the gating time as described above, which is approximately 100 ps. The time difference (interframe time) $T_F$ between resulting images is equivalent to the propagation time for the pulse voltage to propagate between the adjacent X-ray images on the stripline, and is expressed by:

$$T_F = D \cdot \sqrt{\epsilon_r} / C \tag{1}$$

where $\epsilon_r$, is the relative dielectric constant of the MCP 1, C is the velocity of light in vacuum, and D is the interimage distance. If D=2 cm and $\epsilon_r=5$, $T_F$ is calculated as 149 ps from equation (1). In other words, if the X-ray images 2A, 2B and 2C are aligned at an interval of 2 cm, images gated with a gating time of approximately 100 ps can be obtained at an interval of 149 ps.

The gated X-ray imaging system described above, however, suffers a transmission loss in the stripline, and therefore the voltage on the output side will inevitably become lower than the pulse voltage on the input side. Stated more specifically, a MCP which has many pores suffers a particularly large transmission loss and its gain characteristic will vary exponentially with applied voltage. Hence, the variation in voltage is substantially reflected in the output images. As shown in FIG. 9C, the voltage $V_{mcp}$ will decrease toward the output side, producing optical images on the phosphor screen that are darker on the output side of the stripline than on the input side.

SUMMARY OF THE INVENTION

The present invention has been accomplished under the circumstances of the prior art described above and its principal object is to provide an ultrafast gating apparatus that can perform a gating operation at a very high speed without compromising the uniformity in the brightness (gain) of the images obtained.

This object of the present invention can be attained by an ultrafast gating apparatus equipped with a device for gating X-ray images, electron images or optical images being projected onto a stripline by a pulse voltage propagating through said stripline, which apparatus is characterized in that the characteristic impedance, $Z_i$, of said stripline on the input side where the pulse voltage is applied is made smaller than the characteristic impedance on the output side, $Z_o$.

In a preferred embodiment, the width $W_i$ of a transmission path on the input side where the pulse voltage is applied is made greater than the width on the output side, $W_o$.

In another preferred embodiment, the gating device is composed of a stripline comprising a microchannel plate and a transmission path formed on the input surface of the microchannel plate.

In a further preferred embodiment, the transmission path is adapted to serve as a conversion surface.

In another preferred embodiment, said gating device is composed of a stripline comprising a photocathode, transmission path and reference electrode.

In yet another preferred embodiment, said stripline is in the form of either a slot line, a coplanar waveguide or a tri-plate line.

In accordance with the present invention, the characteristic impedance of the stripline on the input side where the pulse voltage is applied is made smaller than the characteristic impedance on the output side, which compensates for the voltage drop that would otherwise occur on account of transmission loss, whereby the voltage applied is transmitted at a constant level along the stripline from its entrance to exit end, insuring that a constant gain is attained irrespective of the position on the stripline.

BRIEF DESCRIPTION OF THE DRAWINGS

FIG. 1A is a plan view of an ultrafast gating apparatus according to an embodiment of the present invention;

FIG. 1B is a sectional view of the same apparatus;

FIG. 1C is a diagram showing pulse voltages across a MCP along a stripline;

FIG. 2 is a diagram showing the relationship between the characteristic impedance and dimensions of a stripline;

DETAILED DESCRIPTION OF THE PREFERRED EMBODIMENTS

Figure 3A:
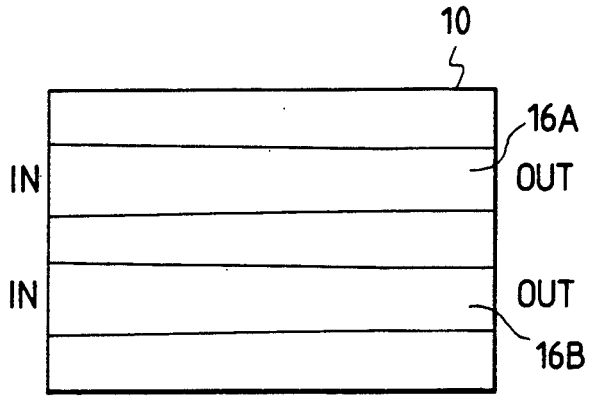
FIGS. 3A through 3C are plan views showing other various configurations of the stripline.
Figure 3B:
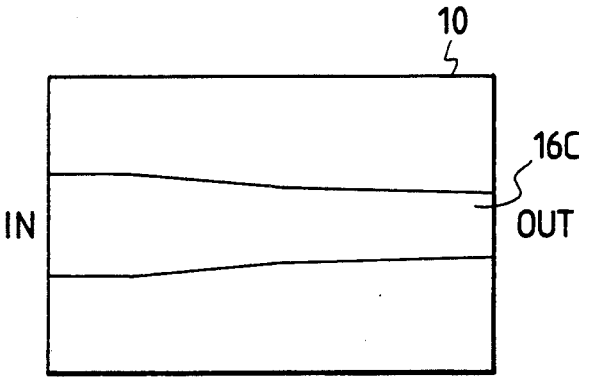

Embodiments of the present invention are described below with reference to FIGS. 1–7.

In its first embodiment, the present invention is applied to a gated X-ray imaging system (X-ray framing camera) that uses MCP 10 to gate X-ray images with a gating time of about 100 ps at the maximum. On the MCP 10 in this gated X-ray imaging system is vapor-deposited a gold transmission path 12 that also serves as a conversion surface for effecting conversion of X-rays to electrons. A stripline is formed by the transmission path 12, the MCP 10 as a dielectric, a grounded electrode 14 on the output surface of the MCP 10.

In accordance with the present invention, the width $W_i$ of the transmission path 12 on its input side is made greater than the width on the output side $W_o$. This provides a characteristic impedance profile which can compensate for a voltage drop due to transmission loss that would otherwise occur. In other words, the transmission path 12 is so constructed that the pulse voltage applied will be transmitted at a constant level ($V_{mcp}$) along the path from its entrance to exit end. Suppose here that the transmission loss that occurs in the absence of the above impedance profile is such that with the input pulse voltage of 1,000 volts the output pulse voltage becomes 800 volts. If the stripline has a characteristic impedance on the input side of 10Ω, a voltage of 1,000 volts can be obtained at the output end by adjusting the characteristic impedance on the output side to 15.6Ω. This may be understood from the following consideration. The input power $P_i$, transmission power loss $P_L$, and output power $P_o$, can be correlated as:

$$P_i = P_L + P_o. \quad (2)$$

Using the general relationship of:

$$P = V^2/R, \quad (3)$$

the following equation is obtained:

$$P_o = (800)^2/10 = (1{,}000)^2/Z_{out}. \quad (4)$$

From equation (4), one can see that an output pulse voltage of 1000 V can be obtained if $Z_{out}$ is adjusted to 15.6Ω. As a result, the voltage $V_{mcp}$ is held constant at 1,000 volts as shown in FIG. 1C and the intensity of the images produced along the stripline is uniform from its input to output end. X-ray images projected on the transmission path 12 are denoted by 12A, 12B and 12C in FIG. 1A.

The characteristic impedance of a stripline is generally correlated to its width, W, and the thickness, h, of the dielectric (MCP) as shown in FIG. 2. One can see from FIG. 2 that by decreasing the width of stripline W toward the output end so as to compensate for the transmission loss of voltage, the voltage across the MCP 10 along the stripline can be held constant.

Figure 3C:
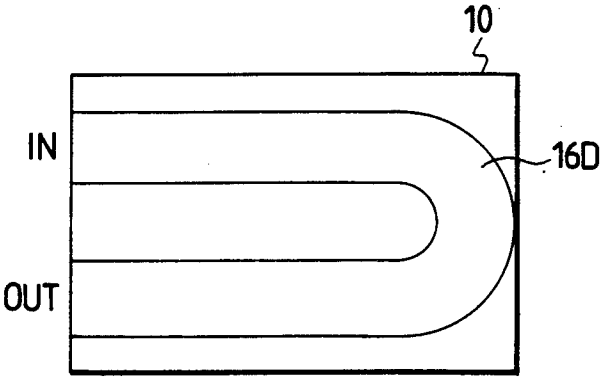

In the embodiment described above, only one stripline is used and its width is made smaller toward the output end in a linear fashion. It should, however, be noted that the present invention is by no means limited to this particular case and various modifications can of course be made, which include using two striplines 16A and 16B (see FIG. 3A), effecting impedance change in a selected area of a single stripline 16C (FIG. 3B), and using a U-shaped stripline 16D (FIG. 3C).

Furthermore, it is noted that using the arrangement similar to that shown in FIGS. 1A through 1C, electron images projected on the transmission path can be gated.

Figure 4:
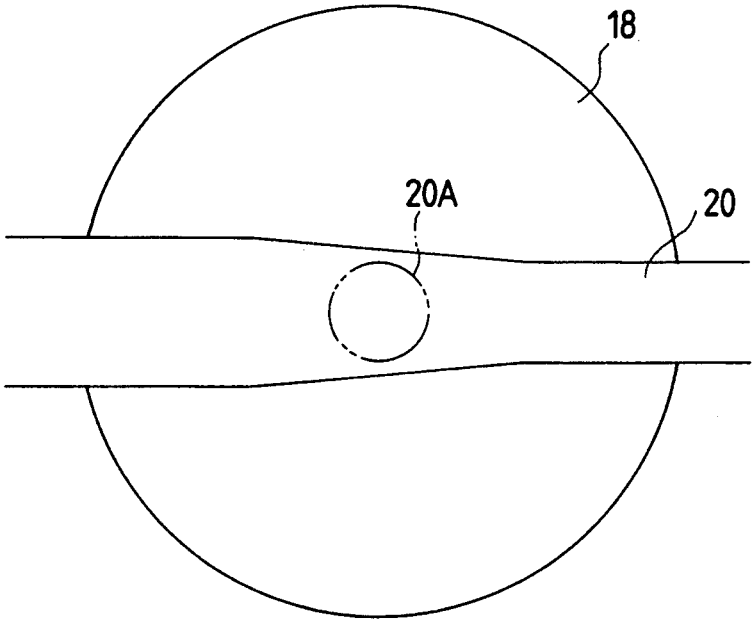
FIG. 4 is a plan view showing another embodiment of the present invention in which the gating device comprises a photocathode.
Figure 5:
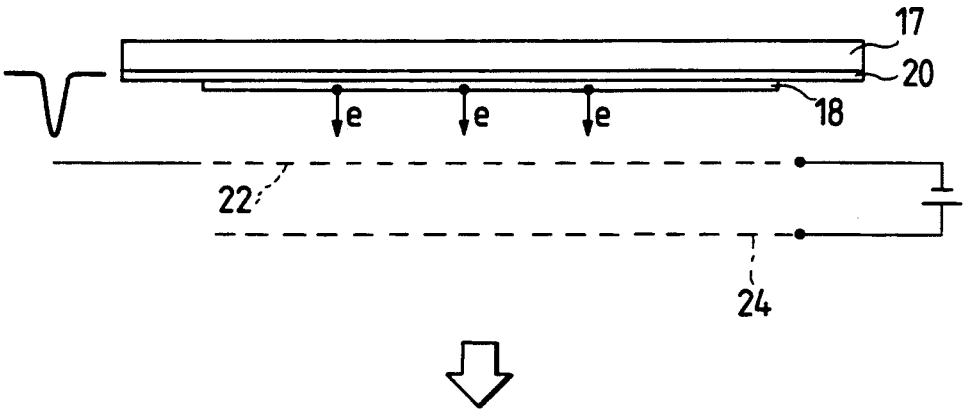
FIG. 5 is a sectional view of the same embodiment.
Figure 6:
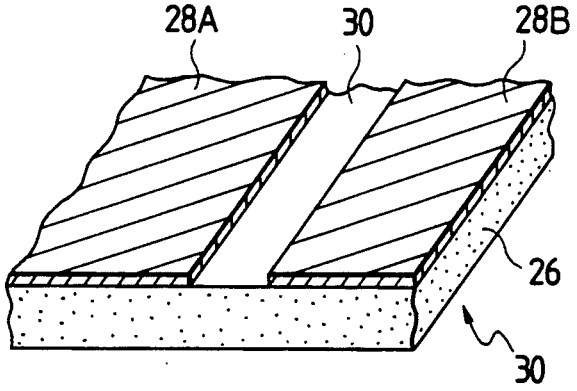
FIGS. 6 and 7 are perspective views showing other striplines to which the present invention can be applied.
Figure 7:
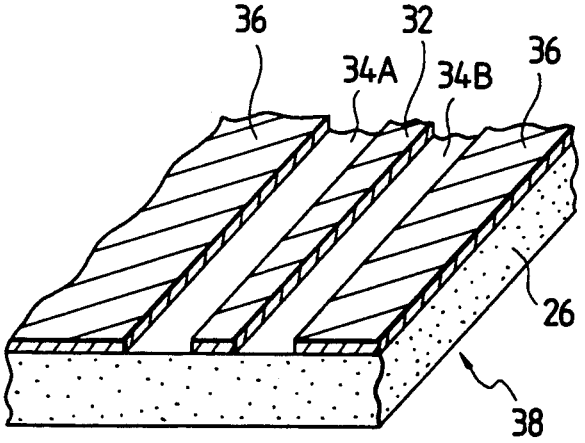
Figure 8:
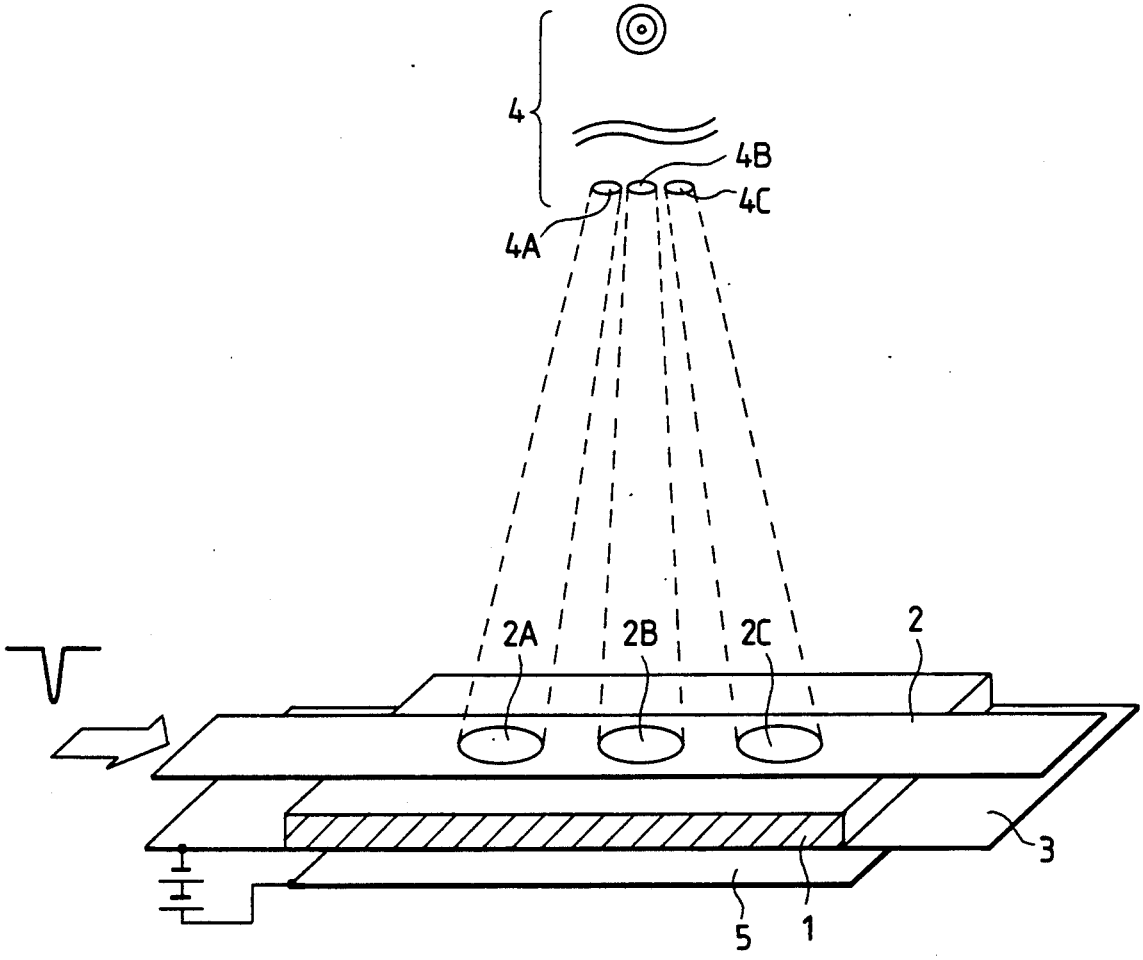
FIG. 8 PRIOR ART
FIG. 8 is a perspective view showing the essential part of a conventional gated X-ray imaging system.
Figures 9A, 9B, 9C:
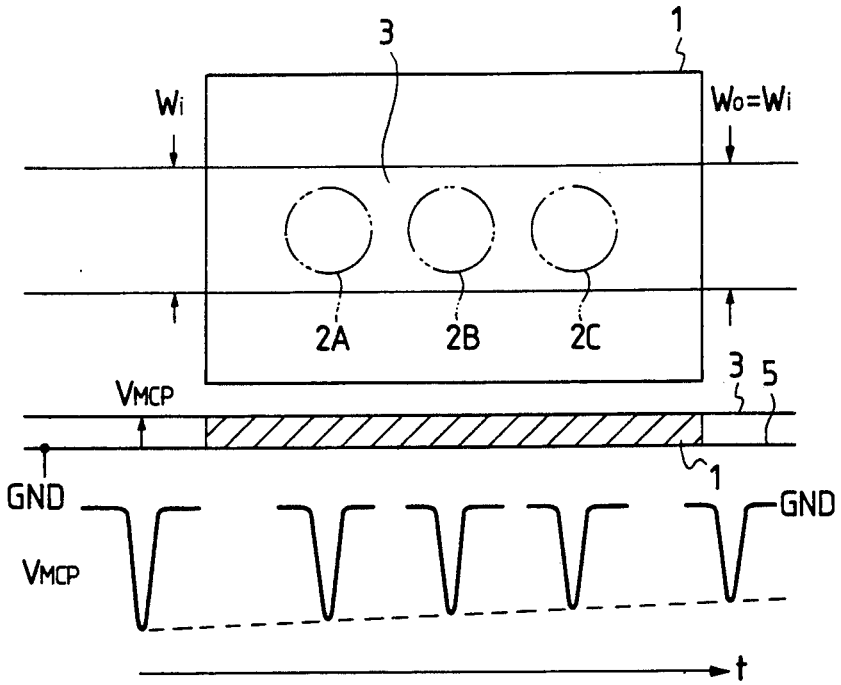
FIG. 9A PRIOR ART
FIG. 9B PRIOR ART
FIG. 9C PRIOR ART
FIG. 9A is a plan view showing the essential part of the same conventional gated X-ray imaging system.
FIG. 9B is a sectional view of FIG. 9A.
FIG. 9C is a diagram showing the profile of pulse voltages across a MCP along a stripline in the conventional gated X-ray imaging system shown in FIGS. 9A and 9B.

Another embodiment of the present invention is shown in FIGS. 4 and 5, in which a photocathode is used in a gating device. In this embodiment, a transparent and electrically conductive transmission path 20 is formed on a glass plate 17 or the like (omitted in FIG. 4) by vacuum vapor deposition, etc., and further a photocathode 18 is formed on the transmission path 20. A pulse voltage is applied to the transmission path 20 with a voltage of an auxiliary electrode 22 or mesh electrode 24 as a reference voltage.

When a pulse voltage is applied to the transmission path 20, the potential difference created between the auxiliary electrode 22 and the photocathode 18 causes photoelectrons to be emitted from the photocathode 18, which photoelectrons pass through the auxiliary electrode 22 and are further accelerated by the mesh electrode 24 to reach an imaging section (not shown). The time in which photoelectrons are emitted from the photocathode 18 is determined by the width of the pulse voltage.

As shown in FIG. 4, the transmission path 20 is so formed that its width decreases toward the output side to insure that the same voltage will develop within the region where an optical image 20A is to be projected. By virtue of this configuration, the photoelectrons emitted from the photocathode 18 will have the same initial velocity in every position on the stripline, whereby images of uniform brightness or resolution can be produced in the imaging section.

The embodiment of FIGS. 4 and 5 is modified such that a transparent and electrically conductive reference voltage layer is formed on the glass plate 17 or the like by vacuum vapor deposition, etc., and the auxiliary electrode 22 or accelerating mesh electrode 24 works as the transmission path to which a pulse voltage is applied.

The stripline shown in FIG. 1 has a single transmission path provided on a dielectric substrate. It should, however, be noted that the present invention is by no means limited to this particular case and it may of course be applied to other forms of stripline, such as a slot line 30 having metal films 28A and 28B and a groove 30 formed therebetween on a dielectric substrate 26 (see FIG. 6), a coplanar waveguide 38 comprising a strip center plate 32, metal plates 36, and grooves 34A and 34B on both sides of the strip center plate 32 on a dielectric substrate 26 (FIG. 7), and a tri-plate line.

As described on the foregoing pages, the stripline used in the ultrafast gating apparatus of the present invention has such characteristic impedance profile as can compensate for the transmission loss, whereby the pulse voltage remains constant in every part of the stripline. As a result, the gating apparatus of the present invention offers &he advantage that the gain of multiplication or the initial velocity of emitted photoelectrons can be made uniform to insure the production of uniform images.

What is claimed is:

1. In a ultrafast gating apparatus having a stripline for gating input X-ray images, electron images or optical images projected onto the stripline by a pulse voltage applied to and propagating through the stripline, the improvement wherein:

a characteristic impedance of the stripline on its input side is smaller than a characteristic impedance on its output side.

2. The apparatus according to claim 1, wherein a width of a transmission path of the stripline on the input side is greater than that on the output side.

3. The apparatus according to claim 2, wherein the width of the transmission path changes linearly from the input side to the output side.

4. The apparatus according to claim 1, wherein the stripline comprises a microchannel plate and a transmission path formed on the microchannel plate.

5. The apparatus according to claim 4, wherein the X-ray images are projected onto the transmission path and thereby converted to electron images.

6. The apparatus according to claim 1, wherein the stripline comprises a photocathode to which the optical images are projected, a transmission path and a reference electrode, the pulse voltage being applied between the transmission path and the reference electrode to accelerate photoelectrons emitted from the photocathode.

7. The apparatus according to claim 1, wherein the stripline is a slot line.

8. The apparatus according to claim 1, wherein the stripline is a coplanar waveguide.

9. The apparatus according to claim 1, wherein the stripline is a tri-plate line.

* * * * *